United States Patent [19]

Gurries

[11] Patent Number: 4,467,539

[45] Date of Patent: Aug. 28, 1984

[54] RESONANCE AIDED FRONT END LOADER

[75] Inventor: Raymond A. Gurries, Reno, Nev.

[73] Assignee: Resonant Technology Company, Sparks, Nev.

[21] Appl. No.: 503,641

[22] Filed: Jun. 10, 1983

Related U.S. Application Data

[63] Continuation of Ser. No. 313,101, Oct. 20, 1981, abandoned.

[51] Int. Cl.[3] ..... E02F 3/76

[52] U.S. Cl. ..... 37/118 R; 37/141 R; 37/DIG. 18; 172/40; 172/816; 173/49; 173/100; 30/277

[58] Field of Search ..... 37/118 R, 118 A, DIG. 18, 37/141 R, 141 T; 172/40, 816; 173/49, 100; 30/277

[56] References Cited

U.S. PATENT DOCUMENTS

| | | | |
|---|---|---|---|
| 3,145,488 | 8/1964 | French | 172/40 X |
| 3,367,716 | 2/1968 | Bodine | 37/DIG. 18 |
| 3,443,327 | 5/1969 | Martin | 172/40 X |
| 3,478,450 | 11/1969 | Cunningham | 37/DIG. 18 |
| 3,628,265 | 12/1971 | Galis | 37/DIG. 18 X |
| 3,633,680 | 1/1972 | Shatto, Jr. | 172/40 X |
| 3,645,021 | 2/1972 | Sonerud | 37/141 T |
| 3,770,322 | 11/1973 | Cobb et al. | 37/DIG. 18 |
| 3,795,070 | 3/1974 | Bronson et al. | 37/DIG. 18 |
| 4,229,045 | 10/1980 | Gurries | 37/DIG. 18 X |
| 4,230,369 | 10/1980 | Gurries | 174/40 X |
| 4,310,054 | 1/1982 | Gurries et al. | 30/277 X |
| 4,359,102 | 11/1982 | Gurries et al. | 37/DIG. 18 |

*Primary Examiner*—E. H. Eickholt

*Attorney, Agent, or Firm*—Townsend and Townsend

[57] ABSTRACT

A front end loader has a loading bucket secured to a tractor and a transversely elongate cutter blade closely spaced forward of a lower front edge of the bucket. Improved apparatus for reciprocating the blade in forward and aft directions relative to the front edge of the bucket is disclosed. A force transmitting beam has a resonant frequency with at least one node and first and second anti-nodes at the resonant frequency. A source of vibrations at or near the resonant frequency is coupled to the beam near the first anti-node to vibrate the second anti-node about a neutral position. The beam is secured near one node so as to locate the neutral position of the second anti-node in spaced relationship from the cutting blade within striking distance thereof. The second anti-node thus applies unidirectional force impulses to the blade in a forward direction as the second anti-node vibrates to drive the blade intermittently forward.

16 Claims, 3 Drawing Figures

RESONANCE AIDED FRONT END LOADER

This is a continuation of application Ser. No. 06/313,101, filed Oct. 20, 1981, and now abandoned.

BACKGROUND OF THE INVENTION

This invention relates to earth-working equipment, and, more particularly, to more efficient use of vibration energy as an aid to the operation of front end loaders and the like.

Front end loaders are in common use on construction sites and elsewhere. A front end loader generally comprises a large loading bucket for earth digging and loading. The bucket is carried on the front end of a tractor. A tractive force of the tractor pushes the bucket forward to scoop up a load of loose material, and the bucket then can be lifted for carrying and unloading the material. An elongate blade typically extends across the lower front edge of the bucket for assisting penetration of the bucket into the material being scooped up.

There is a need to reduce the tractive force required for a front end loader to penetrate the material being loaded. For example, if the material being loaded suddenly cannot be penetrated, the vehicle can spin its tires when applying a tractive force. Premature tire wear can be a considerable expense for front end loaders but this expense can be avoided by reducing the required tractive force in penetrating the material. In the past, efforts have been devoted to the use of high-frequency vibrating blades on the bucket of a front end loader as an aid to reducing the required tractive force. U.S. Pat. No. 3,238,646 to Oldenburg discloses one prior effort in which the blade is connected to a vibrating eccentric through a bell crank for imparting vibration to the blade in forward and aft directions. U.S. Pat. No. 3,328,904 to Vaigt et al discloses a power assisted loading bucket having reciprocally mounted teeth at the front edge of the bucket.

SUMMARY OF THE INVENTION

A front end loader has a loading bucket secured to a tractor and a transversely elongate cutter blade closely spaced forward of a lower front edge of the bucket. Improved apparatus for reciprocating the blade in forward and aft directions relative to the front edge of the bucket is disclosed. A force transmitting beam has a resonant frequency with at least one node and first and second antinodes at the resonant frequency. A source of vibrations at or near the resonant frequency is coupled to the beam near the first antinode to vibrate the second antinode about a neutral position. The beam is secured near one node so as to locate the neutral position of the second antinode in spaced relationship from the cutting blade within striking distance thereof. The second antinode thus applies unidirectional force impulses to the blade in a forward direction as the second antinode vibrates to drive the blade intermittently forward.

In one embodiment of the invention, the bucket shell carries matched angulated force transmitting beams, each having two divergent approximately straight legs that couple vibratory force to the cutter blade extending across the front edge of the bucket shell. Each beam has a resonant frequency, a node at a juncture when restrained, an input antinode at the end of one leg, and an output anti-node at the end of the other leg at the resonant frequency. A source of vibrations at or near the resonant frequency is coupled to each beam near its input anti-node, and its output anti-node is coupled to the cutter blade to transmit to the blade the vibratory energy from the source. If two or more beams are used as is preferred, they are mounted on the shell at transversely spaced apart points in a balanced relationship.

In the apparatus of the present invention, the resonant beam is secured to the bucket at the node. The node is basically stationary, and thus the input vibrational forces are not transferred to the bucket at the point of attachment, except for reaction forces at the result of the second anti-node striking the cutter blade. This is in direct contrast to prior devices, in which the vibrating mechanism imparted an equal opposite force on the bucket, thus limiting the force of the vibrations which could be applied. Since unwanted vibrational forces are not exerted on the bucket, much larger forces can be imparted on the cutting blade with the apparatus of the present invention so that the cutter blade can cut through hard materials. In many instances, this can reduce number of operations required, for example by eliminating the need for an additional piece of equipment to initially rip or loosen the material being loaded.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
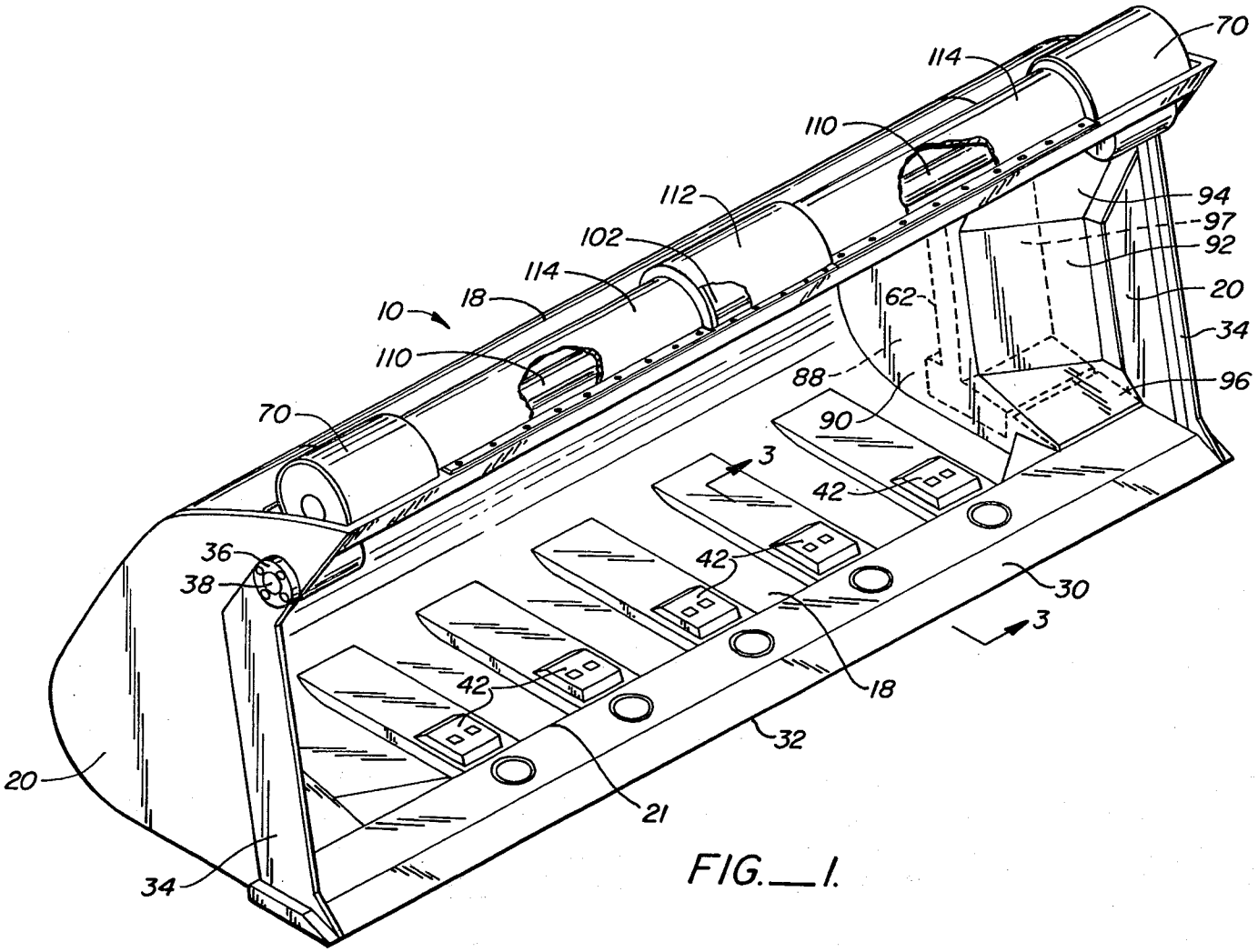
FIG. 1 is a perspective view showing a bucket loader according to principles of this invention.

Referring to the drawings, a front end loader bucket 10 is conventionally secured to upright rear support members 12 (see FIG. 2) on opposite sides of the bucket center line. Bucket 10 is secured to the front end of a tractor, not shown, by a pair of parallel push and lift arms 14 secured to lower portions of the rear support members 12 and a pair of roll back and dump cylinders 16 secured to upper portions of the rear support members.

Figure 2:
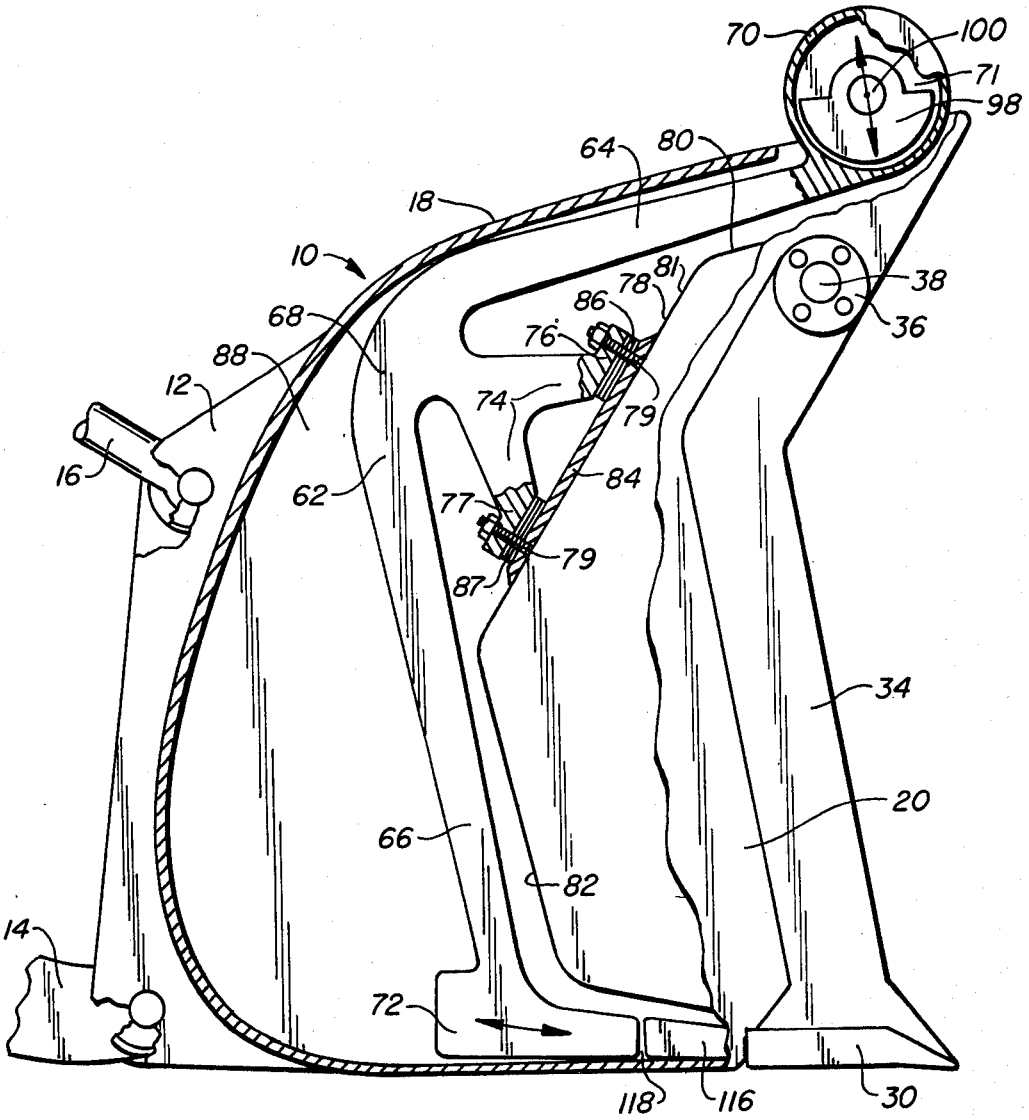
FIG. 2 is a side elevation view of the embodiment of FIG. 1 with portions broken away.

The bucket generally includes a concave metal shell 18 which is elongate and generally C-shaped when viewed from an end as in FIG. 2. Metal end plates 20 are rigidly secured to opposite ends of shell 18. The bucket thus produces a generally elongate laterally extending hollow interior area with a concave rear wall formed by the shell 18 of the bucket, with a laterally extending front opening between the end plates 20. The bucket also has an elongate lower edge 21 extending across the front of the bucket between the end plates.

A transversely elongate cutter blade 30 extends across and in front of the lower front edge 21 of the bucket. Cutter blade 30 has a blade edge 32 that penetrates loosened material being loaded into the bucket. The opposite ends of the cutter blade are attached, for example by welding, to the bottoms of a pair of upright hanger arms 34. The top of each hanger arm has a pivot 36 and a corresponding pivot pin 38 affixed to the pivot. The hangers are outboard the end plates, and the pivot pins are journaled for rotation in corresponding bearings inside the end plates. The hangers pivot relative to the end plates about a transverse axis through the pivot pins to permit the cutter blade to reciprocate relative to the bucket.

Figure 3:
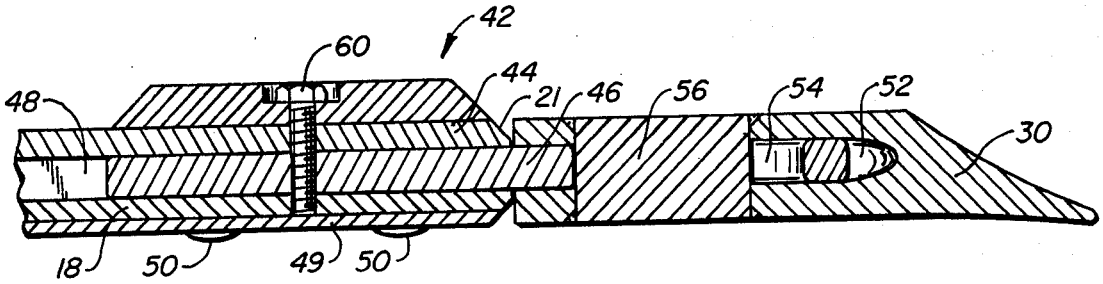
FIG. 3 is a fragmentary sectional view taken on line 3—3 of FIG. 1.

The length of blade 30 is supported adjacent lower front edge 21 of bucket 18 by a plurality of laterally spaced apart blade supports 42. Blade supports 42 are identical and are understood best by referring to FIG. 3. Each blade support 42 includes an elongate rigid stiffening member 44 rigidly affixed to the floor of bucket shell 18. Each stiffening member is immediately inboard the front edge 21 of the bucket and extends perpendicularly away from the front edge of the bucket in an aft direction. Separate attachment plates 46 have rear portions fastened to stiffening members 44 and front portions fastened to laterally spaced apart locations along the body of cutter blade 30. Rear portions of the attachement plates extend into corresponding channels 48 formed in the stiffening members. Separate plates 49 cover the bottom surface of the shell below the attachment plates 46. The rear portions of attachment plates 46, together with the bottom plates 49 and stiffening member 44, are rigidly affixed to the shell by fasteners such as bolts 50. Protective covers 58 cover the attachment bolts 50, and each protective cover is fastened to the stiffening members and the attachment plates by bolts 60.

The front portions of attachment plates 46 are secured to the body of blade 30 in a slidable arrangement which permits the blade to move forward and aft relative to the lower front edge 21 of the shell. The front portions of attachment members 46 extend into corresponding elongate slots 52 penetrating the rear of the blade. The slots are elongated in the direction of movement of blade 30. Separate oblong holes 54 extend through the front portions of attachment plates 46. The length of each oblong hole 54 is aligned with the direction of movement of blade 30. Separate fixed pins 56 extend through oblong holes 54 for slidably attaching blade 30 to attachment plates 46. Each pin 56 is rigidly affixed, for example by welding, to the body of blade 30 above and below slot 52. Pins 56 are circular in cross-section and smaller in diameter than long dimension of slots 54. This means of attachment enables cutter blade 30 to reciprocate fore and aft as the pins ride in the elongated slots 54, thereby guiding the cutter blade and taking up side and vertical thrust; and rear edge portions of the oblong holes engage the rear portions of the pins to act as stops thereby limiting the stroke of the cutter blade in its aft direction. Specifically, the maximum stroke of cutter blade 30 is equal to the long dimension of oblong holes 54.

Referring to FIGS. 1 and 2, separate angulated force transmitting resonant beams 62 are disposed adjacent the inside faces of each end wall 20 of bucket 18. Beams 62 are matched in the sense that they resonate at the same frequency, have the same dimensions, and are made from the same material. Each beam 62 is preferably of one piece cast or machined construction, and includes diverging, approximately straight upper and lower legs 64 and 66 that meet at a juncture 68 to form an acute, approximately 90 degree, angle. Each beam 62 also includes an oscillator housing 70 at the end of the upper leg, a hammer 72 at the end of the lower leg, a pair of intermediate extensions 74 at the juncture of the beam extending outwardly at an angle that bisects the upper and lower legs, and transverse mounting flanges 76 and 77 formed on the ends of the intermediate extensions.

The resonant beams are rigidly affixed to separate angulated beam mounting webs 78 which, in turn, are rigidly affixed to the inside walls of the end plates 20, for example by welding. Each web 78 is generally C-shaped and includes a straight upper leg 80 extending generally parallel to and below the upper leg of the resonant beam, an upper intermediate leg 81 extending downwardly and in an aft direction at a relatively steep angle generally parallel to mounting flanges 76, 77 of resonant beam 62, a lower intermediate leg 82 extending generally downwardly at a relatively steep angle and generally parallel to lower leg 66 of the resonant beam, and a lower leg 83 which extends downwardly and in a forward direction at a relatively shallow angle generally parallel to hammer portion 72 of the resonant beam.

Separate mounting pads 84 are formed on the rear surface of the upper intermediate leg of each web. The resonant beams are mounted to the back of each upper intermediate leg by bolts 79 extending through the mounting flanges 76 and 77 of the resonant beams and the mounting pads 84 of the webs. Shims 86 and 87 are interposed between the mounting flanges and the pads to precisely set, at the time of assembly and readjust in the course of operation, the position of each hammer 72 with respect to blade 30.

Separate protective cavities 83 are formed inboard of the end walls of the bucket for housing the resonant beams and the beam mounting webs. Each protective cavity is formed, in part, by a vertical side wall 90 spaced from and extending parallel to the end plates of the bucket. Each side wall supports the outer edge of the beam mounting web 78 and is rigidly affixed, say by welding, to the rear inside surface of the bucket shell for support. Each side wall 90 extends from the bottom to the top inside surface of the bucket and extends alongside each resonant beam. Each cavity also includes an angular deflector wall 92 extending at an angle from the side wall 90 toward the inside face of the end plate 20, an upper plate 94 extending from the top of the deflector 92 toward the inside face of the end plate, and a lower plate 96 extending from the base of the deflector 92 in a forward direction and at a relatively shallow angle for covering the hammer portion of the resonant beam and the portion of the cutter blade contacted by the hammer. An upright front wall 97 is rigidly affixed between the inside of the end plate and the upper and lower plates 94, 96 and the deflector 92. The wall structure surrounding each cavity 88 forms a deflector for material entering the bucket and also forms a guard for resonant beam 62 inside each cavity.

Referring again to resonant beams 62, when restrained at each juncture 68, the beams have a node at the juncture and anti-nodes at the ends of the upper and lower legs 64 and 66, when excited at or near an appropriate resonant frequency. The anti-node at the end of upper leg 64 serves as an input of beam 62 and the anti-node at the end of lower leg 66 serves as the output of the beam. The upper and lower legs 64, 66 are each tapered in thickness from the juncture 68 of beam 62 to their respective ends, i.e., as depicted in FIG. 2 each leg is wider near the juncture than it is near its end, for the purpose of equalizing the bending stresses along the length of each leg.

An oscillator 71 is disposed in housing 70. Oscillator 71 comprises at least one, and preferably three eccentric weights 98 mounted on a shaft 100, which is journaled for rotation in the housing 70. Preferably, the weight of hammer 72 is equal to or less than the weight of the oscillator, including its housing, shaft, bearings and eccentric weights. If the hammer is too heavy, the input anti-node vibrates with a larger amplitude than the output anti-node.

A double-ended hydraulic motor 102 (see FIG. 1) is mounted to the upper rear portion of bucket shell 18. Motor 102 is preferably a hydraulic motor driven by a hydraulic pump located on the tractor and not shown. Flexible drive shafts 110 couple the opposite output shafts of the motor to oscillators 71 in the housings 70 at opposite ends of the bucket. A motor guard 112 and drive shaft covers 114 provide protection for the motor and drive shafts, respectively.

As the eccentric weights rotate on the shaft at or near the resonant frequency of the beam, the beam is excited into at least near resonant vibration. The input anti-node at the end of upper leg 64 of the beam vibrates transversely to its length, the output anti-node of the lower leg 66 vibrates transversely to its length, and the hammer 72 intermittently strikes the back of an anvil 116 formed on the back portion of the cutter blade. The anvil portions 116 of the cutter blade 30 are projections formed on opposite ends of the cutter blade which taper in an aft direction toward the front face of each hammer 72.

The neutral position of the output anti-node of each resonant beam 62 is defined herein as its position when the beam is at rest, i.e., when it is not vibrating or being deflected. Regardless of the position of cutter blade 30, it is at all times spaced from the neutral position of the output anti-node of each beam, thereby forming a gap 118. When each beam 62 is energized by its oscillator 71, its output anti-node vibrates, i.e., reciprocates fore and aft; and as the output anti-node moves forward, gap 118 closes and hammer 72 strikes the back of cutter blade 30, and as the hammer moves aft, the gap opens. Specifically, pins 56 serve as tool stops on the aft movement of cutter blade 30 when they contact the rear portions of elongated holes 54 in attachment plates 46. The desired minimum gap is established by the number of shims 86 and 87 which changes the spacing between hammer 72 and anvil surface 116 of the blade.

During operation of oscillator 71 and resonant beams 62, the peak-to-peak vibration excursion amplitude of each output anti-node is generally on the order of one inch. Hammer 72 contacts anvil surface 116 of cutter blade 30 near the forward peak of the vibration excursion of the output anti-node. Hammer 72 drives cutter blade 30 forward relative to the lower front edge of bucket 18, until the pins 56 approach or contact the front portions of the elongated holes 54. As hammer 72 moves aft, out of contact with anvil surface 116 of cutter blade 30, the cutter blade can slide in an aft direction relative to the bucket. This aft motion is produced in response to forward motion applied to bucket 18 by the tractor. As blade 30 moves in a relative aft direction, it can be stopped by the pins 56 engaging the rear portions of the elongated holes 54. During the next cycle hammer 72 moves forward and again strikes cutter blade 30 to drive the cutter blade forward, and this cycle continues to be repeated. In this manner, the hammer applies unidirectional force impulses to the cutter blade to drive the cutter blade intermittently in a forward direction without aft motion as the tractor moves steadily forward relative to the shell of the bucket, the cutter blade reciprocates as the tractor drives the bucket steadily forward and the resonant beam strikes the blade.

The described embodiment of the invention is only considered to be preferred and illustrative of the inventive concepts; the scope of the invention is not to be resticted to such embodiments. Various and other numerous arrangements may be devised by one skilled in the art without departing from the spirit and scope of this invention.

What is claimed is:

1. In a front end loader having a loading bucket secured to a tractor and a transversely elongate cutter blade closely spaced forward of a lower front edge of the bucket improved apparatus for reciprocating the blade in forward and aft directions relative to the front edge of the bucket, the improvement comprising:

a force-transmitting beam having two divergent approximately straight legs that meet at a junction to form an angle of less than 180°, said beam having a resonant frequency with a node at the junction and first and second anti-nodes at the ends of the beam;

a source of vibrations at or near the resonant frequency coupled to the beam near the first anti-node to vibrate the second anti-node about a neutral position; and means for securing the beam near the one node so as to position the neutral position of the second anti-node in spaced aft relationship from the cutter blade within striking distance thereof to apply unidirectional force impulses to the blade in a forward direction as the second anti-node vibrates to drive the blade intermittently forward.

2. The improvement according to claim 1 in which the divergent legs of the beam meet at an angle of approximately 90 degrees.

3. The improvement according to claim 1 in which the cutter blade mounting means additionally comprises stop means for preventing aft movement of the cutter blade beyond a point forwardly spaced from the neutral position of the second anti-node.

4. The improvement according to claim 3 in which the stop means comprises a plurality of elongated slots formed in a portion of the bucket in alignment with the direction of movement of the blade, and a plurality of pins riding in the slots and attaching the blade to the bucket to stop the cutter blade when the pins reach the ends of the slots.

5. The improvement according to claim 4 in which the stop means further includes a plurality of laterally spaced apart support members rigidly affixed to the bottom of the bucket and protruding forward of the lower front edge of the bucket; and in which the pins slidably secure the blade to the protruding porions of the members.

6. Apparatus according to claim 5 including laterally spaced apart stiffening members rigidly secured to corresponding support members.

7. The improvement according to claim 4 in which the pins provide guiding means for preventing sideward motion of the cutter blade.

8. For use on a front end loader, a loading bucket comprising:

an elongate shell shaped as a bucket for receiving material loaded onto the shell;

a transversely elongate cutter blade closely spaced from a lower front edge of the shell;

means for mounting the cutter blade for reciprocal motion in forward and aft directions relative to the lower front edge of the shell;

a force-transmitting beam having two divergent approximately straight legs that meet at a junction to form an angle of less than 180°, said beam having a resonant frequency and a node at the junction and first and second anti-nodes at the ends of the beam;

a source of vibrations at or near the resonant frequency coupled to the beam near the first anti-node to vibrate the second anti-node about a neutral position;

means for securing the beam near the one node so as to position the neutral position of the second anti-node in spaced aft relationship from the cutter blade within the striking distance thereof to apply force impulses to the blade in a forward direction as the beam vibrates to drive the blade intermittently forward; and stop means for preventing aft movement of the cutter blade beyond a point forwardly spaced from the neutral position of the second anti-node.

9. Apparatus according to claim 8 in which the stop means comprises a plurality of elongated slots formed in a portion of the bucket in alignment with the direction of movement of the blade, and a plurality of pins riding in the slots and attaching the blade to the bucket to stop the blade when the pins reach the ends of the slots.

10. Apparatus according to claim 9 in which the stop means further includes a plurality of laterally spaced apart support members rigidly affixed to the bottom of the bucket and protruding forward of the lower front edge of the bucket; and in which the pins slidably secure the blade to the protruding portions of the support members.

11. Apparatus according to claim 10 and additionally comprising laterally spaced apart stiffening members rigidly secured to corresponding support members.

12. Apparatus according to claim 9 in which the pins provide guide means for preventing sideward motion of the cutter blade.

13. For use on a front end loader, a loading bucket comprising:

an elongate shell shaped as a bucket for receiving material loaded onto the shell;

a transversely elongate cutter blade closely spaced from a lower front edge of the shell;

means for mounting the cutter blade for reciprocal motion in forward and aft directions relative to the lower front edge of the shell;

a force-transmitting beam having a resonant frequency and at least one node and first and second anti-nodes at the resonant frequency;

a source of vibrations at or near the resonant frequency coupled to the beam near the first anti-node to vibrate the second anti-node about a neutral position;

means for securing the beam near the one node so as to position the neutral position of the second anti-node in spaced aft relationship from the cutter blade within the striking distance thereof to apply force impulses to the blade in a favored direction as the beam vibrates to drive the blade intermittently forward;

a plurality of elongated slots formed in a portion of the shell in alignment with the direction of movement of the blade; and a plurality of pins riding in the slots and attaching the blade to the shell to stop the blade when the pins reach the ends of the slots and prevent aft movement of the cutter blade beyond a point forwardly spaced from the neutral position of the second anti-node.

14. Apparatus according to claim 13 and additionally comprising a plurality of laterally spaced apart support members rigidly affixed to the bottom of the shell and protruding forward of the lower front edge of the shell; and in which the pins slidably secure the blade to the protruding portions of the support members.

15. Apparatus according to claim 14 and additionally comprising laterally spaced apart stiffening members rigidly secured to corresponding support members.

16. Apparatus according to claim 13 in which the pins provide guide means for preventing sideward motion of the cutter blade.

* * * * *